US007578651B2

(12) United States Patent
Layko et al.

(10) Patent No.: US 7,578,651 B2
(45) **Date of Patent: *Aug. 25, 2009**

(54) METHOD OF LIFTING A BOOM ASSEMBLY

(75) Inventors: Michael C. Layko, Apex, NC (US); Jeffrey M. Parker, Fuquay-Varina, NC (US)

(73) Assignee: Caterpillar S.A.R.L., Geneva (CH)

( * ) Notice: Subject to any disclaimer, the term of this patent is extended or adjusted under 35 U.S.C. 154(b) by 163 days.

This patent is subject to a terminal disclaimer.

(21) Appl. No.: 11/644,542

(22) Filed: Dec. 21, 2006

(65) Prior Publication Data

US 2007/0104566 A1 May 10, 2007

Related U.S. Application Data

(63) Continuation-in-part of application No. 11/137,521, filed on May 26, 2005, now Pat. No. 7,264,435.

(51) Int. Cl.
*B66C 23/00* (2006.01)

(52) U.S. Cl. ..... 414/815; 414/686

(58) Field of Classification Search ..... 414/686, 414/685, 680, 917, 800, 809, 815
See application file for complete search history.

(56) References Cited

U.S. PATENT DOCUMENTS

| | | | | |
|---|---|---|---|---|
| 4,355,946 | A | 10/1982 | Wykhuis et al. | |
| 5,042,602 | A | 8/1991 | Nakatani et al. | |
| 5,078,568 | A | 1/1992 | Lynnes | |
| 5,169,278 | A | 12/1992 | Hoechst et al. | |
| 5,184,932 | A | 2/1993 | Misuda et al. | |
| 5,470,190 | A | 11/1995 | Bamford et al. | |
| 5,470,192 | A | 11/1995 | Parri et al. | |
| 5,511,932 | A | 4/1996 | Todd et al. | |
| 5,542,814 | A | 8/1996 | Ashcroft et al. | |
| 5,609,464 | A | 3/1997 | Moffitt et al. | |
| 5,807,061 | A | 9/1998 | Donoghue et al. | |
| 5,820,332 | A | 10/1998 | Philips et al. | |
| 5,964,567 | A | 10/1999 | Bamford | |
| 6,132,163 | A | 10/2000 | Andrews et al. | |
| 6,171,050 | B1 | 1/2001 | Johnson | |
| 6,238,130 | B1 | 5/2001 | Youngers | |
| 6,325,589 | B1 | 12/2001 | Jang et al. | |
| 6,575,262 | B2 | 6/2003 | Nagatsuka | |
| 6,616,398 | B2 | 9/2003 | Dershem et al. | |
| 6,679,674 | B1 | 1/2004 | Branham | |
| 6,695,568 | B2 | 2/2004 | Bares et al. | |
| 7,264,435 | B2 * | 9/2007 | Layko et al. | 414/686 |
| 2004/0028514 | A1 | 2/2004 | Mimuro | |

* cited by examiner

*Primary Examiner*—Donald Underwood
(74) *Attorney, Agent, or Firm*—William Beckman

(57) ABSTRACT

A method of lifting a boom assembly for a machine along a lift path is provided. The machine has a work implement coupled to the boom assembly. The method includes initially moving the work implement vertically from a lowered position to a first intermediate position forward of the lowered position. The method also includes subsequently moving the work implement vertically from the first intermediate position along a slightly rearwardly inclined direction to a second intermediate position rearward of the first intermediate position. The method also includes subsequently moving the work implement vertically from the second intermediate position along a slightly forwardly inclined direction to a third intermediate position forward of the second intermediate position. The method also includes finally moving the work implement vertically from the third intermediate position along a slightly rearward inclined direction to a final position rearward of the first, second, and third intermediate positions.

11 Claims, 2 Drawing Sheets

METHOD OF LIFTING A BOOM ASSEMBLY

CLAIM FOR PRIORITY

The present application is a continuation-in-part of U.S. application Ser. No. 11/137,521, filed May 26, 2005 now U.S. Pat. No. 7,264,435, for a Lift Boom Assembly, which is fully incorporated herein.

TECHNICAL FIELD

This disclosure relates generally to a method of lifting a boom assembly for a machine, and more particularly to a method of lifting a boom assembly along a desired work implement lift and lowering path.

BACKGROUND

Various machines include work implements that are raised and lowered to perform desired tasks. For example, skid steer loader machines may include a bucket that is raised and lowered to assist in transferring material between desired locations. In many cases, such work implements are coupled to a frame of a machine by a lift boom assembly that serves to control the movement of the work implement between the lowered and raised positions. Conventional lift boom assemblies include a boom directly coupled to a frame of the machine by a single pivot connection. This single pivot connection causes the work implement to travel along an arcuate path between the raised and lowered positions. In particular, when the boom starts to raise, there is forward movement of the work implement and, after the boom goes over center, there is a substantial amount of upward and rearward movement of the work implement. This lift path has the drawback of shortening the forward reach of the work implement when the boom is in the raised position.

Attempts have been made to overcome the drawbacks associated with boom assemblies having arcuate lift paths. For example, U.S. Pat. No. 5,542,814 issued to Ashcroft, et al. ("the '814 patent"), discloses a method of lifting a skid steer loader boom assembly along a generally "s"-shaped lift path. The "s"-shaped lift path is lifted in a generally vertical path until it reaches a first intermediate point, after which it is lifted along a path that inclines forward until it reaches a second intermediate point. Above the second intermediate point, the lift path travels along a generally vertical path until it reaches its maximum height. While the lift path provided by the disclosed boom assembly of the '814 patent seeks to improve over the lift path of the single pivot boom assembly, as illustrated in FIG. 3 of the '814 patent, the lift path may sacrifice machine stability for a more vertical path between the raised and lowered positions. In particular, at the second intermediate point in the lift path of the '814 patent, the bucket obtains its maximum forward reach, which is generally sustained until the bucket reaches its maximum height. With a loaded bucket in the region between the second intermediate point and the maximum height, the loaded machine center of gravity moves forward and increases the likelihood for the machine to tip over.

The present disclosure is directed to overcoming one or more of the problems set forth above.

SUMMARY OF THE DISCLOSURE

In accordance with one aspect of the disclosure, a method of lifting a boom assembly for a machine along a lift path is provided. The machine has a work implement coupled to the boom assembly. The method includes the step of initially moving the work implement vertically from a lowered position to a first intermediate position that is forward of the lowered position. The method also includes the step of subsequently moving the work implement vertically from the first intermediate position along a slightly rearwardly inclined direction to a second intermediate position that is rearward of the first intermediate position. The method also includes the step of subsequently moving the work implement vertically from the second intermediate position along a slightly forwardly inclined direction to a third intermediate position that is forward of the second intermediate position. The method also includes the step of finally moving the work implement vertically from the third intermediate position along a slightly rearward inclined direction to a final position that is rearward of the first, second, and third intermediate positions.

According to another aspect of the present disclosure, a method of lifting a boom assembly for a skid steer loader along a lift path is provided. The skid steer loader has a work implement coupled to the boom assembly. The method includes the step of initially moving the work implement vertically from a lowered position to a first intermediate position that is forward of the lowered position. The method also includes the step of subsequently moving the work implement vertically from the first intermediate position along a slightly rearwardly inclined direction to a second intermediate position that is rearward of the first intermediate position. The method also includes the step of subsequently moving the work implement vertically from the second intermediate position along a slightly forwardly inclined direction to a third intermediate position that is forward of the second intermediate position and rearward of the first intermediate position. The method also includes the step of finally moving the work implement vertically from the third intermediate position along a slightly rearward inclined direction to a final position that is rearward of the first, second, and third intermediate positions.

DETAILED DESCRIPTION

Figure 1:
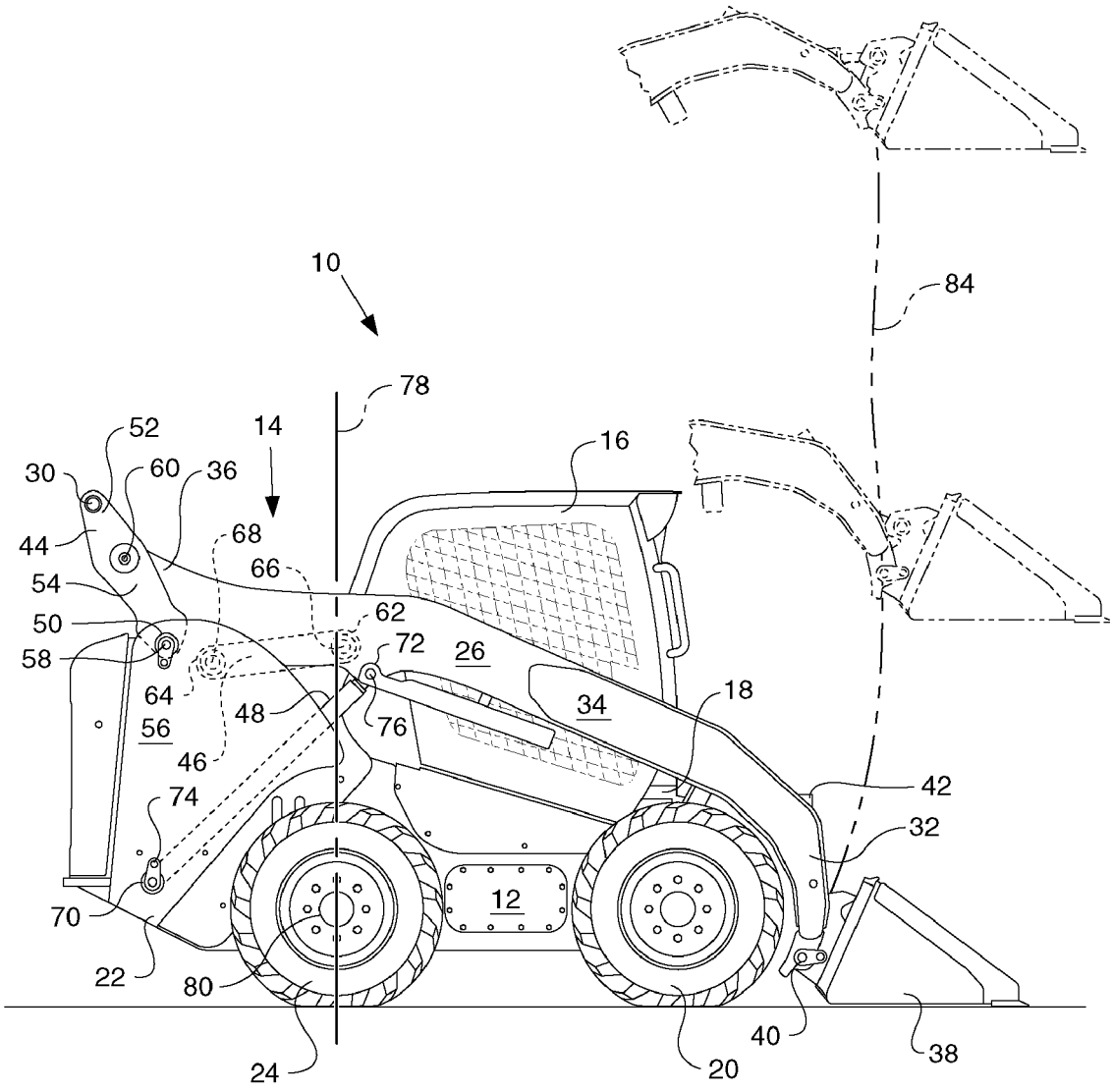
FIG. 1 is a partially-schematic side view of a machine including an exemplary boom assembly in accordance with the present disclosure.

With reference to FIG. 1, a machine 10 includes a frame assembly 12 having a boom assembly 14 and an operator compartment 16 coupled thereto. The machine 10 is depicted as a skid steer loader, but may be any other type of machine incorporating a boom assembly 14 for performing work. For example, machine 10 may alternatively be a front end loader or backhoe loader type machine. The frame assembly 12 includes a front frame portion 18 having a front traction assembly 20, and a rear frame portion 22 having a rear traction assembly 24. Front and rear traction assemblies 20, 24 may include wheels as shown in FIG. 1, or may include portions of a track type tractor assembly.

Boom assembly 14 may include a pair of booms 26 located on opposite sides of the frame assembly 12 (only one boom is shown in the figures). Each boom 26 is formed in a substantially similar manner and may be connected together by one or more cross members 30 extending across the machine 10.

Each boom 26 includes a front boom portion 32, a middle boom portion 34, and a rear boom portion 36. When in a lowered position as shown in FIG. 1, rear boom portion 36 may extend generally horizontally and middle and front boom portions 34, 32 may together extend generally downwardly toward the ground. Alternatively, boom 26 could be of any other appropriate shape extending from front frame portion 18 toward rear frame portion 22. Each boom 26 may include a single, integral beam, or may include numerous boom segments fixedly coupled together in any appropriate manner.

Front boom portion 32 of boom 26 may include a work implement 38 coupled thereto. Work implement 38 may include a bucket as shown in FIG. 1, or any other type of work implement known in the art. For example, work implement 38 may alternatively include a fork lift assembly. Work implement 38 may be coupled to front boom portion 32 in any conventional manner. For example, work implement 38 may be directly connected to front boom portion 32 by pivot connection 40, and indirectly connected to front boom portion 32 by an operator controlled hydraulic or pneumatic actuator 42.

Rear boom portion 36 may be connected to a rear link member 44, a forward link member 46, and a hydraulic or pneumatic actuator 48 to provide a coupling between the boom 26 and the rear frame portion 22. Rear link member 44 may include a first end portion 50, a second end portion 52, and an intermediate or middle portion 54. First end portion 50 of rear link member 44 may be pivotally coupled to a tower assembly 56 of rear frame portion 22 to form a frame pivot connection 58 of rear link member 44. Second end portion 52 of rear link member 44 may include cross member 30 extending across the machine 10 and connecting to a second end portion of a second rear link member (not shown). Intermediate portion 54 of rear link member 44 may include a boom pivot connection 60 coupling the rear link member 44 and rear boom portion 36 of boom 26. As illustrated in FIG. 1, rear link member 44 may extend rearwardly and upwardly between the first end portion 50 and the second end portion 52 when the boom assembly 14 is in the lowered position. As used herein, the "lowered position" of the boom assembly 14 identifies the position of the boom assembly when the work implement is located on or adjacent the ground.

Forward link member 46 may include a first end portion 62 and a second end portion 64. First end portion 62 of forward link member 46 may be pivotally connected to rear frame portion 22 to form a frame pivot connection 66 of forward link member 46. Second end portion 64 of forward link member 46 may include a boom pivot connection 68 coupling the second end portion 64 of forward link member 46 and the rear boom portion 36. As shown in FIG. 1, forward link member 46 may extend rearwardly and downwardly between the first end portion 62 and the second end portion 64 when the boom assembly 14 is in the lowered position.

Actuator 48 may include a first end portion 70 and a second end portion 72. First end portion 70 of actuator 48 may be pivotally connected to rear frame portion 22 to form a frame pivot connection 74 of actuator 48. Second end portion 72 of actuator 48 may be connected to the intermediate boom portion 34 by boom pivot connection 76. As illustrated in FIG. 1, actuator 48 may extend forwardly and upwardly along the machine 10 between the first end portion 70 and second end portion 72 when the boom assembly 14 is in the lowered position. As noted above, actuator 48 may be actuated hydraulically or pneumatically and may be configured to include the actuator cylinder at either the first or second end portions 70, 72 of the actuator 48. Finally, actuator 48 may be controlled in any appropriate manner, including by electronically, hydraulically, or pneumatically driven actuator valves receiving control signals based on, for example, machine operator input received from within the operator compartment 16 of the machine 10.

Referring again to FIG. 1, the location of the rear link member 44, forward link member 46, and actuator 48 will be described with respect to the position 78 of an axle 80 of the rear traction assembly 24, and with respect to the boom assembly 14 being in the lowered position shown in the figure. Frame pivot connection 58 of rear link member 44 and frame pivot connection 74 of actuator 48 may both be located rearward of the axle 80 of the rear traction assembly 24. Frame pivot connection 66 of forward link member 46 may be located forward of axle 80 of the rear traction assembly 24.

Again with respect to the boom assembly 14 in the lowered position as shown in FIG. 1, the boom pivot connections 60 and 68 of the rear link member 44 and the forward link member 46 may be positioned rearward of the axle 80 of the rear traction assembly 24, with the boom pivot connection 60 of the rear link member 44 positioned a greater distance rearwardly of axle 80 than the boom pivot connection 68 of the forward link member 46. The boom pivot connection 76 of the actuator 48 may be located forward of the axle 80. In addition, when the boom assembly 14 is in the lowered position, boom pivot connection 60 of the rear link member 44 may be located above the boom pivot connection 68 of forward link member 46, which may be located above the boom pivot connection 76 of the actuator 48.

INDUSTRIAL APPLICABILITY

The disclosed boom assembly may be used with any machine having a work implement that is raised and lowered to perform a desired task. In one exemplary embodiment, the boom assembly may be used on a skid steer loader type machine.

Referring to FIG. 1, during operation of the machine 10, an operator manipulates the boom assembly 14 to a desired vertical position along a lift path 84 via operator controls (not shown) located in the operator compartment 16. Based on the input received from the operator controls, the actuators 48 of the machine will either extend or retract to adjust the boom member 26 to a desired location. When the boom assembly 14 is initially moved from the lowered position by the hydraulic actuators 48, the rear link member 44 is pivoted rearward about frame pivot connection 58 a predetermined distance. Simultaneously, the forward link member 46 is pivoted upward about frame pivot connection 66. Upon further movement of the lift boom assembly 14 to the raised position, the rear link member 44 is pivoted forward about frame pivot connection 58. As the boom assembly 14 is raised or lowered along the lift path 84 to a desired position, an operator may, if necessary, operate actuator 42 to curl the work implement 38 relative to the front boom portions 32 of booms 26 about pivot connection 40.

Figure 2:
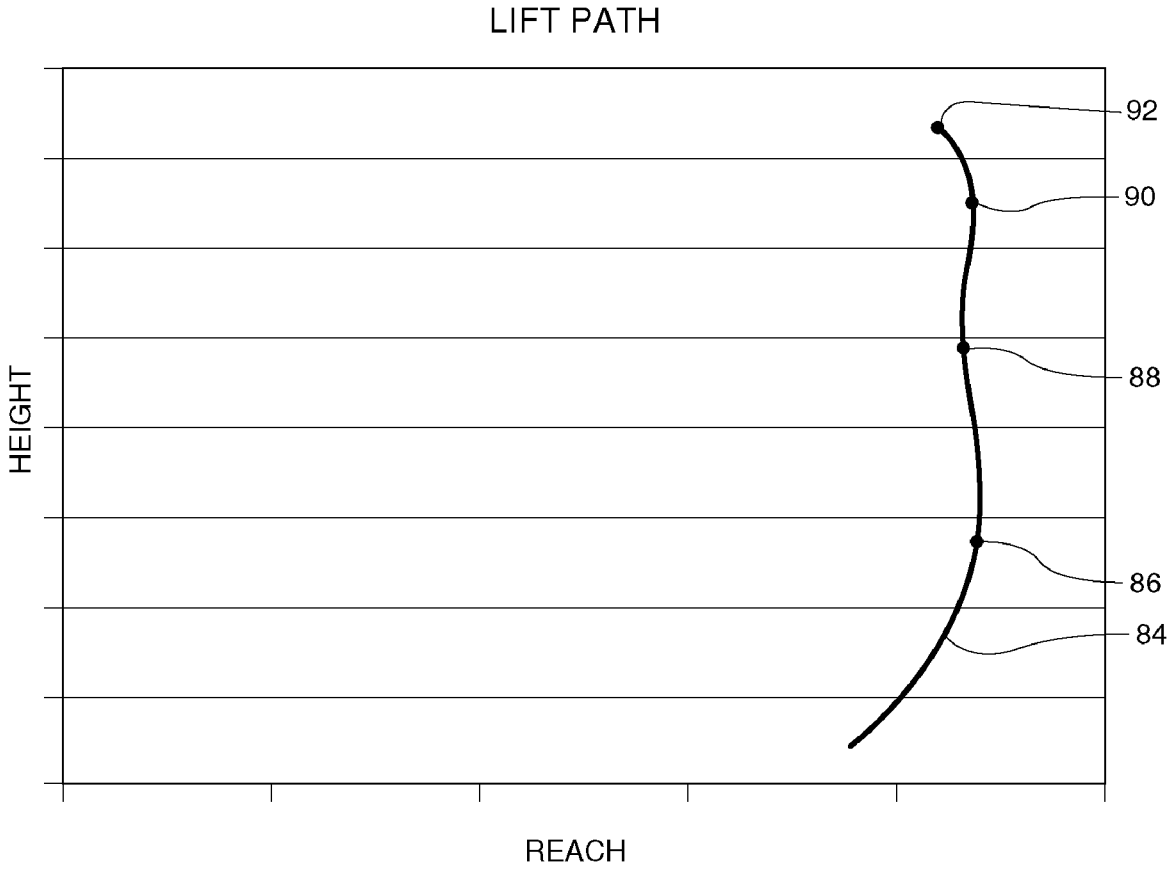
FIG. 2 is a graph of the lift path of the machine of FIG. 1, illustrating the relative vertical height versus the reach of the boom assembly along the lift path.

As seen in FIG. 2, the lift path 84 follows a "w" shaped pattern as the work implement 38 is raised or lowered. The lift path 84 is defined by a first, second, and third intermediate position 86, 88, 90 and a final position 92. As the work implement 38 is lifted vertically along the lift path 84, the work implement 38 is lifted typically from an initial lowered position in close proximity to the ground in a generally forward inclined path until it reaches the approximate vicinity of first intermediate position 86, at which point it reaches its maximum forward position. As the work implement 38 is lifted vertically beyond the first intermediate position 86, it follows a generally rearward inclined path, at which point it reaches the second intermediate position 88, which is rearward of the first intermediate position 86. As the work implement is lifted vertically beyond the second intermediate position 88, it follows a general vertical path, until it reaches the third intermediate position 90, which is forward of the second intermediate position 88 and rearward of the first intermediate position 86. As the work implement is lifted vertically beyond the third intermediate position 90, the lift path 84 follows a generally rearward inclined path until it reaches it reaches its maximum height at a final position 92. The final position 92 is rearward of the first, second and third intermediate positions 86, 88, and 90. After the work implement 38 is lifted vertically through the lift path 84 to the final position 92, it may be lowered through the third, second, and first intermediate positions 90, 88, and 86, respectively, and returned to a resting position in close proximity to the ground.

This flattened "w" shaped pattern of lift path 84 provides for a semi-vertical path with an increased reach over conventional arcuate lift patterns through the intermediate positions 86, 88, and 90. This configuration also brings the work implement 38 closer to the center of gravity of the machine 10 at the final position 92. This increases the stability of the machine 10 at the final position 92 at the maximum height, which may be ten feet or more for mid-sized skid steer loaders. In addition, positioning the work implement 38 at first intermediate position 86 provides for maximum forward reach at an intermediate height. At such an intermediate height, which is typically approximately four to five feet for a mid-sized skid steer loader, an operator does not need the increased stability provided by final position 92. Through these intermediate heights, it is advantageous to lift the work implement 38 substantially vertically initially to maintain a stable condition until it reaches a transport position slightly elevated above the ground along its lift path 84. Moreover, at these intermediate points, the lift path 84 allows the forward reach of the work implement 38 to extend closer to a desired object located forward of the machine when the boom assembly is in a raised position.

Other embodiments of the invention will be apparent to those skilled in the art from consideration of the specification and practice of the invention disclosed herein. For example, it is intended that the specification and examples be considered as exemplary only, with a true scope of the invention being indicated by the following claims.

What is claimed is:

1. A method of lifting a boom assembly for a machine along a lift path, the machine having a work implement coupled to the boom assembly, comprising the steps of:

initially moving the work implement vertically from a lowered position to a first intermediate position that is forward of the lowered position;

subsequently moving the work implement vertically from the first intermediate position along a slightly rearwardly inclined direction to a second intermediate position that is rearward of the first intermediate position;

subsequently moving the work implement vertically from the second intermediate position along a slightly forwardly inclined direction to a third intermediate position that is forward of the second intermediate position; and finally moving the work implement vertically from the third intermediate position along a slightly rearward inclined direction to a final position that is rearward of the first, second, and third intermediate positions.

2. The method of claim 1, wherein the machine is a skid steer loader.

3. The method of claim 1, wherein the lift path has a W-shaped configuration.

4. The method of claim 1, wherein the first intermediate position is the maximum forward position.

5. The method of claim 1, wherein the third intermediate position is rearward of the first intermediate position.

6. The method of claim 1, wherein the lowered position is in close proximity to the ground.

7. The method of claim 1, including the step of:

lowering the work implement from the final position to a resting position in close proximity to the ground.

8. A method of lifting a boom assembly for a skid steer loader along a lift path, the skid steer loader having a work implement coupled to the boom assembly, comprising the steps of:

initially moving the work implement vertically from a lowered position to a first intermediate position that is forward of the lowered position;

subsequently moving the work implement vertically from the first intermediate position along a slightly rearwardly inclined direction to a second intermediate position that is rearward of the first intermediate position;

subsequently moving the work implement vertically from the second intermediate position along a slightly forwardly inclined direction to a third intermediate position that is forward of the second intermediate position and rearward of the first intermediate position; and finally moving the work implement vertically from the third intermediate position along a slightly rearward inclined direction to a final position that is rearward of the first, second, and third intermediate positions.

9. The method of claim 8, wherein the lift path has a W-shaped configuration.

10. The method of claim 8, wherein the lowered position is in close proximity to the ground.

11. The method of claim 8, including the step of:

lowering the work implement from the final position to a resting position in close proximity to the ground.

* * * * *